United States Patent [19]

Pease

[11] 4,172,155

[45] Oct. 23, 1979

[54] SURFACING CIRCULAR-SECTION METAL MEMBERS

[75] Inventor: Alan Pease, Mexbrough, England

[73] Assignee: British Steel Corporation, London, England

[21] Appl. No.: 908,650

[22] Filed: May 23, 1978

[30] Foreign Application Priority Data

May 27, 1977 [GB] United Kingdom ..... 22493/77

[51] Int. Cl.[2] ..... C23C 7/00

[52] U.S. Cl. ..... 427/34; 427/37; 427/142; 427/360; 427/423; 164/75; 164/92; 29/420.5; 29/527.2; 29/402.18

[58] Field of Search ..... 427/142, 360, 423, 34, 427/37; 164/75, 92, 98, 86, 87, 112, 252, 107, 103, 427; 29/401 R, 401 A, 401 B, 401 C, 401 D, 401 E, 420, 527.2, 527.3, 527.7, 159 R, 159.1; 264/36; 219/73.13, 76.1, 76.11, 76.12, 76.13, 76.14, 76.15, 76.16, 76.17, 78.16, 91.23, 154; 75/208 R, 208 CS

[56] References Cited

U.S. PATENT DOCUMENTS

| | | | |
|---|---|---|---|
| 1,494,410 | 5/1924 | Bidle | 29/159 R |
| 1,947,493 | 2/1934 | Rose et al. | 29/401 |
| 2,318,263 | 5/1943 | Smith | 219/76.11 |
| 2,353,693 | 7/1944 | Church | 75/208 R |
| 3,579,783 | 5/1971 | Hayes et al. | 29/159 R |
| 3,715,790 | 2/1973 | Reinberger | 427/423 X |

FOREIGN PATENT DOCUMENTS

| | | | |
|---|---|---|---|
| 408067 | 4/1934 | United Kingdom | 427/142 |
| 440428 | 12/1935 | United Kingdom | 219/76.1 |
| 556098 | 9/1943 | United Kingdom | 219/76.1 |
| 719046 | 11/1954 | United Kingdom | 219/76.1 |
| 1461748 | 1/1977 | United Kingdom | 219/76.1 |

*Primary Examiner*—Ralph S. Kendall
*Attorney, Agent, or Firm*—Bacon & Thomas

[57] ABSTRACT

A method of surfacing mill guide rolls 1 in which a metallic powder (6) is deposited on to the surface of the rotatable roll by flame, arc or plasma spraying, fusion welded and then shaped and compacted while in a plastic condition by a roll former 7 rotatable and engageable with the guide roll whereby to impart thereto a surface in conformity with the profile of the former.

13 Claims, 4 Drawing Figures

3
5
4
2
1

3
6
4
2
1

3
1
4
2
7
8

9

SURFACING CIRCULAR-SECTION METAL MEMBERS

This invention relates to a method of, and apparatus for, surfacing circular-section metal members, e.g. metal rolls or wheels, etc., by weld deposition.

Surface welding processes are known by which a weld deposit is laid down over a worn roll surface so as to build up a metallic mass over the surface. Subsequently, this re-surfaced roll is then turned or ground to reconstitute its original dimensions. This process is time consuming and costly, requiring expensive equipment in operation.

It is an object of this invention to provide an improved surfacing technique.

From one aspect, the present invention provides a method of surfacing circular-section metal members in which the member is rotated and a metallic powder is deposited on to the circumferential surface by flame, arc or plasma spraying, fusion welded and shaped and compacted whilst in a plastic condition by a roll former rotatable and engageable with the surfaced member whereby to impart thereto a surface in conformity with the profile of the former.

The powder may consist solely of metal with fluxing agents or it may incorporate other materials e.g. oxides or carbides; the deposit laid down may comprise tungsten carbide in a metallic matrix for example. The member may be a mill roll, e.g. a guide roll, but any other circular section members may be surfaced and profiled, e.g. crane wheels.

Preferably the roll former is mounted as an idler and is rotatable by contact with the driven roll; alternatively, both rolls may be driven and they may be driven at different speeds so as to impart a polishing action by which a better surface may be obtained.

The process steps may be performed sequentially or the deposition and fusion welding may be effected substantially simultaneously whilst the roll former is actually in engagement with the surfaced member. In the latter instance, deposition may cease just as soon as the appropriate amount has been laid down. With the sequential arrangement an excess of the surfacing mass will be laid down and this may subsequently be removed whilst in a soft condition by a hand tool before the roll former is applied.

In accordance with this invention then, metal rolls are surfaced and then profiled by a roller press-forming technique, whilst the surface deposit is still soft and workable in this fashion. The surfacing and profile forming are effected in one operation, either simultaneously or in the sense that they are performed successively on the same machine. Hitherto, surfaced rolls have been subsequently turned and/or ground in a separate machine after the roll, together with its surface deposit, have cooled to room temperature, whilst with this invention a separate surface finishing treatment may be dispensed with altogether.

Significant time and cost savings are therefore achieved.

In order that the invention may be fully understood, one embodiment thereof will now be described, by way of example, with reference to the accompanying drawings in which.

Figure 1:
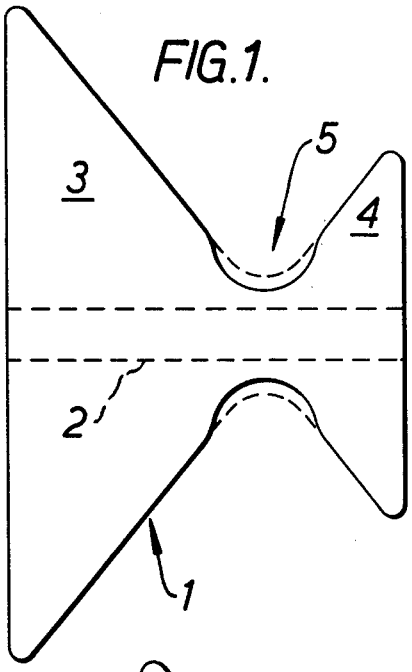
FIG. 1 illustrates a typical worn guide roll.

Referring now to FIG. 1, a typical worn guide roll for a bar mill is illustrated. In particular the steel roll 1 has a bore 2 for receiving an axle about which it rotates as a bar (not shown) is transported in the vee 5 formed between the two flanks 3 and 4. The base of the vee is worn by repeated passage of the bars and the degree of wear can be seen by comparison with the original contour illustrated by dashed lines.

Figure 2:
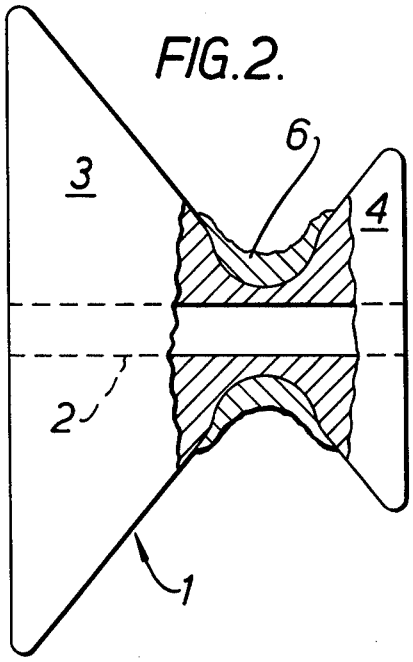
FIG. 2 illustrates this roll after a surfacing deposit has been built up on it.

This roll is first cleaned, e.g. by grit or shot-blasting, grinding or machining securely mounted on a shaft held in a lathe chuck and then slowly rotated as a flame gun, e.g. an oxy-acetylene or other fuel gas torch is applied on it to heat the metal. With a steel guide roll the temperature may be raised to about 500° C. The roll surface is then cleaned of oxides e.g. by brushing, and powdered metal is then flame-spray deposited on to the roll by the torch, the nozzle being directed at the vee 5 where build-up is required. The deposited mass is identified in FIG. 2 by numeral 6.

In particular the powder may typically by a self-flowing nickel-base iron composition embodying chromium, silicon and boron additions suitable for application to ferrous bodies. The working temperature of such a powder may lie between 1050° C. and 1200° C. (solidus say about 975° C.) the powder feed from the gun hopper being oxygen assisted. The rate of deposition may typically be about 0.1 kilos per minute.

Figure 3:
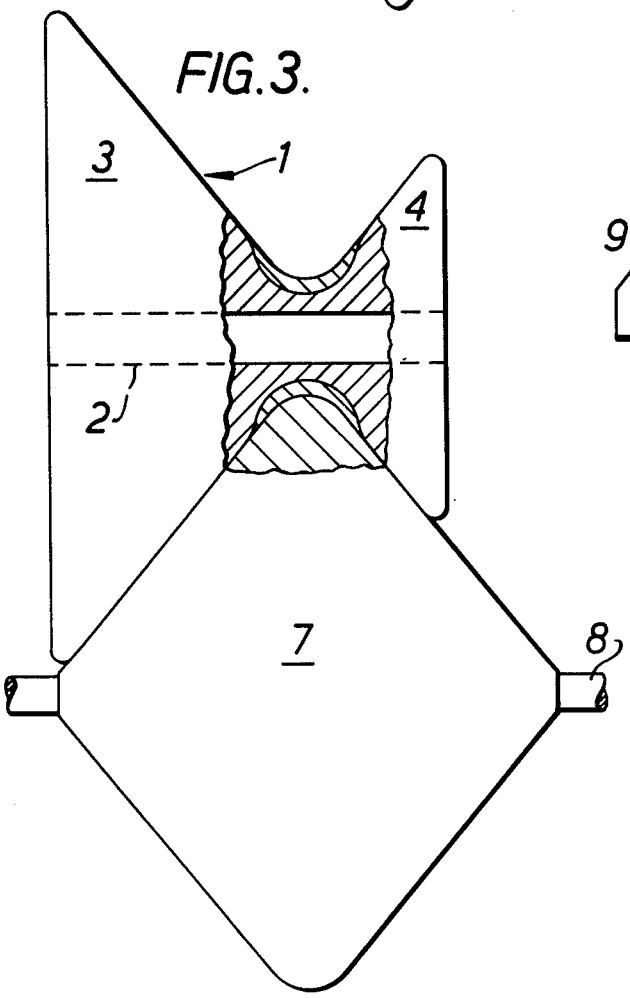
FIG. 3 illustrates the roll forming operation by which the roll former contour is imparted to the guide roll.

Following the deposition of an amount of the powdered metal sufficient to make up the worn deficiency the soft mass 6 is fusion bonded together—and to the roll—by the continued application of the oxy-acetylene torch (without the powder feed) and whilst it is still in a soft and pliable state a steel roll former 7 (FIG. 3)—to which a 'flash' coating of oil or grease is applied to prevent adhesion—is advanced towards the guide roll and rotates in sympathy with it. This former 7, which may be at no more than ambient temperature, is rotatable about an axle 8 and has a surface profile matching that of the guide roll with the object of shaping and compacting the deposition 6 so that the roll will again exhibit its original contour depicted in FIG. 1. Any excess deposited is squeezed away beyond the flanks of the guide roll. When the shaping is completed the roll former is withdrawn, the rotation of the guide roll is arrested and the latter is removed and allowed to cool slowly.

Figure 4:
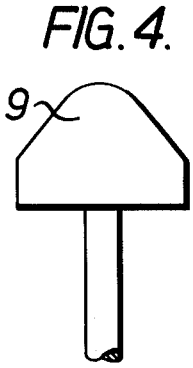
FIG. 4 illustrates a typical tool which may be used for removing excess material before roll forming.

With the sequence described it may be advisable to remove any excess of the deposited material before bringing the roll former into contact to relieve the latter of the 'work' required in shaping this mass. For this purpose a hand tool (FIG. 4) may be applied, the nose blade 9 of this tool being shaped conformity with the vee 5 so as to remove any such excess material therefrom.

In the embodiment described the roll former 7 is an idler, i.e. it is friction driven from the guide roll during the shaping process, but alternatively the roll former may be independently driven at the same speed as the guide roll; alternatively these rotational speeds may differ in which case the shaped surface deposited may be polished somewhat.

Although this invention has been described with reference to the specific embodiment illustrated it is to be understood that various modifications may be made without departing from the scope of this invention. For example, the spray deposition may be effected by a plasma or an arc wire process; the deposition may be made whilst the roll former, or indeed the static tool, is being held against the guide roll, the fusion being effected substantially simultaneously—in this way no excess of material need be deposited and much faster operating times are achieved. The roll former may be pre-heated to avoid any tendency for the fused metal powder to 'freeze' on contact with it, and the former may be made from a ceramic material or some other material having a higher temperature duty than steel.

The pre-heating of the roll and/or the roll former if necessary, may be effected by an electrical induction system. Rolls having a shape other than the guide roll shown may of course be surfaced; multi-groove rolls could equally well be surfaced or indeed the process could be adopted on right-circular cylindrical rolls.

We claim:

1. A method of surfacing circular-section metal members which comprises rotating a circular-section metal member, spray-depositing a metallic powder on the circumferential surface of said member; and fusion welding, shaping, and compacting said metallic powder while the latter is in a plastic condition by engaging a rotatable roll former with the surfaced member whereby to impart to said surfaced member a surface in conformity with the profile of said rotatable roll former, the metallic powder being deposited by flame, plasma or arc spraying.

2. A method according to claim 1, in which the powder deposition and the shaping/compaction are performed sequentially.

3. A method according to claim 2, in which the surface of the member is pre-heated before the powder is deposited.

4. A method according to claim 3, in which the powder comprises several metals together with metallic compounds.

5. A method according to claim 4, in which the compounds are oxides or carbides.

6. A method according to any one of claims 1 to 5, in which the roll former is an idler and is rotatable by contact with the driven member.

7. A method according to any one of claims 1 to 5, in which both the member and the roll former are driven.

8. A method according to claim 7, in which the member and the roll former are driven at different speeds of rotation.

9. A method according to claim 2, in which an excess of powder is deposited and in which the bulk of the excess is removed by a tool shaped substantially in conformity with the profile of the former before shaping/compaction is effected by the roll former.

10. A method of surfacing circular-section metal members which comprises rotating a circular-section metal member, spray-depositing a metallic powder on the circumferential surface of said member; and fusion welding, shaping, and compacting said metallic powder while the latter is in a plastic condition by engaging an independently driven rotatable roll former with the surfaced member whereby to impart to said surfaced member a surface in conformity with the profile of said rotatable roll former, the metallic powder being deposited by flame, plasma or arc spraying.

11. A method according to claim 10, in which the surface of the member is conditioned by grit blasting before the powder is deposited.

12. A method according to claim 10 or claim 11, in which the deposition and fusion welding is effected whilst the roll former is in engagement with the surfaced member.

13. A method according to claim 10 or claim 11 in which the powder deposition and the shaping/compaction are performed sequentially.

* * * * *